US007665721B2

(12) United States Patent
Palamides et al.

(10) Patent No.: US 7,665,721 B2
(45) Date of Patent: Feb. 23, 2010

(54) DEVICE FOR FORMING STACKS OF FLAT PRODUCTS

(75) Inventors: Stefano Palamides, Grafenau (DE); Marcus Gasser, Bietigheim-Bissingen (DE)

(73) Assignee: Palamides GmbH, Renningen (DE)

( * ) Notice: Subject to any disclaimer, the term of this patent is extended or adjusted under 35 U.S.C. 154(b) by 0 days.

(21) Appl. No.: 12/202,745

(22) Filed: Sep. 2, 2008

(65) Prior Publication Data

US 2009/0057999 A1 Mar. 5, 2009

Related U.S. Application Data

(63) Continuation of application No. PCT/EP2007/001786, filed on Mar. 2, 2007.

(30) Foreign Application Priority Data

Mar. 6, 2006 (DE) ..... 10 2006 011 642

(51) Int. Cl.
*B65H 3/44* (2006.01)

(52) U.S. Cl. ..... 271/9.01; 271/9.04; 271/9.13

(58) Field of Classification Search ..... 271/151, 271/9.04, 9.13, 9.01, 68, 182, 202 SJ; 198/363, 198/418.3, 418.2, 431, 448; 270/58.29, 58.25, 270/58.23

See application file for complete search history.

(56) References Cited

U.S. PATENT DOCUMENTS

| | | | | |
|---|---|---|---|---|
| 4,696,464 | A | 9/1987 | Gämmerler | |
| 4,805,890 | A * | 2/1989 | Martin | 271/203 |
| 5,415,385 | A * | 5/1995 | Newsome et al. | 270/58.25 |
| 5,727,781 | A * | 3/1998 | Muller | 270/58.23 |
| 6,659,445 | B2 * | 12/2003 | Boss | 271/9.13 |
| 6,945,531 | B2 * | 9/2005 | Perobelli et al. | 271/270 |
| 7,281,709 | B2 * | 10/2007 | Honegger | 271/9.01 |
| 2005/0035521 | A1 * | 2/2005 | Stauber et al. | 270/58.23 |

FOREIGN PATENT DOCUMENTS

| | | |
|---|---|---|
| DE | 35 02 896 A1 | 7/1986 |
| DE | 199 15 506 A1 | 10/2000 |
| EP | 0 189 896 | 8/1986 |
| EP | 1 371 590 A1 | 12/2003 |
| EP | 1 475 329 A1 | 11/2004 |

* cited by examiner

*Primary Examiner*—Kaitlin S Joerger
(74) *Attorney, Agent, or Firm*—Harness, Dickey & Pierce, P.L.C.

(57) ABSTRACT

A device for forming stacks of flat products comprises a first transportation section for transporting a stream of individual flat products of a first type, a second transportation section for forming an overlapping stream from the flat products of the first type, and a stacking unit for forming individual stacks from the overlapping stream. The device further comprises a feed unit for flat products of a second type, whereby the feed unit introduces the flat products of the second type inline into the stream of individual flat products of the first type.

10 Claims, 4 Drawing Sheets

DEVICE FOR FORMING STACKS OF FLAT PRODUCTS

CROSS REFERENCE TO RELATED APPLICATIONS

This application is a continuation of pending international application PCT/EP2007/001786, filed Mar. 2, 2007, designating US, which claims priority from German patent application DE 10 2006 011 642.9 filed Mar. 6, 2006. The entire contents of these applications are incorporated herein by reference.

BACKGROUND OF THE INVENTION

The invention relates to a device for forming stacks of flat products, comprising a first transportation section for transporting a stream of individual flat products of a first type, a second transportation section for forming an overlapping stream from the flat products of the first type, and a stacking unit for forming individual stacks from the overlapping stream.

The invention also relates to a method for forming stacks of flat products, comprising the following steps:

(a) generating a stream of individual flat products of a first type;

(b) transporting the stream of individual flat products of the first type;

(c) forming an overlapping stream from the individual flat products of the first type;

(d) forming individual stacks from the overlapping stream.

In the production of flat products and, in particular, in the mass production of flat printing products, these flat products are generally individually transported away from a production machine and collated into an overlapping stream. This overlapping stream is then divided into stacks. These stacks are collected and for example banded or otherwise packed for onward dispatch.

Devices for carrying out this operation are also referred to as automatic delivery devices. Such devices are produced, for example, by the Assignee of the Applicants and are sold under the type designation delta700.

The stacks which are formed in this way, particularly when they are produced from limp flat products, exhibit the problem that they themselves are limp and often very rapidly fold over, which makes them difficult to handle and can result, moreover, in damage to the flat products.

It has further been shown that a simple banding of such a stack can result in the topmost and bottommost flat products possibly being damaged by external influences.

It has therefore proved advantageous to provide such stacks on the top and bottom side respectively with a flexurally rigid material, such as, for example, a firm piece of cardboard, in order, on the one hand, to lend the stack a certain rigidity and, on the other hand, to protect the topmost and bottommost flat products from damage.

It is also often desirable to provide a stack of flat products, either at the top or bottom, with a further flat product which offers, for example, more precise information on the content of the stack.

It is known to attach such further flat products to a stack by direct placement onto the stack.

This has the drawback, however, that it reduces the speed at which a stack-forming device is operated. Moreover, the overall size of the device specified in the introduction is also thereby markedly increased.

SUMMARY OF THE INVENTION

It is therefore an object of the present invention to refine a device and a method for forming stacks of flat products of the type specified in the introduction such that stacks of flat products of a first type can thus be formed, into which flat products of a second type are introduced and this at a high operating speed and without markedly increasing the overall size of such a device.

According to the invention, the object is achieved by the fact that on the device for forming stacks of flat products a feed unit for flat products of a second type is present, the feed unit introducing the flat products of the second type inline into the stream of individual flat products of the first type.

In a method according to the invention, in step (b) of transporting the stream of individual flat products of the first type, at least one flat product of a second type is introduced into the stream of flat products of the first type.

By the term "flat product" as it is herein used shall be understood to mean all products whose thickness is many times less than their length and width. This includes, in particular, flat paper and cardboard products such as printing products, but also flat plastic or metal products.

These flat products can be of any type, whereby the flat products of the first type differ in at least one feature from those of the second type. This feature can be, for example, the shape, the material, but also the imprint.

An inline feeding of the flat products enables these to be introduced at the same speed with which the individual flat products of the first type move on the transportation section. Therefore, no delay whatsoever is incurred upon the introduction of the flat products of the second type, since the space between the flat products of the first type can be used for introducing the flat products of the second type, without the first transportation section needing to be slowed.

The inline introduction of the flat products of the second type enables the feed device, moreover, to be arranged in parallel above the first transportation section, so that no lengthening or widening of the device ensues. This allows, in particular, a compact construction.

The feed unit can thereby have any form known to the person skilled in the art and consists, for example, of a single-item pick-up device and a conveyor belt.

In one embodiment of the invention, the feed unit introduces the flat products of the second type into the stream of individual flat products of the first type at an interface between the first transportation section and the second transportation section.

In particular, flat products having several pages or folded flat products are often transported between two conveyor belts to prevent them from opening up or unfolding. At the interface between the first and the second transportation section, a gap in the conveyor belts is generally obtained thereby, into which the feed unit can easily introduce the flat products of the second type without the need for further structural alterations to known devices for forming stacks of flat products.

In a further embodiment of the invention, the first transportation section comprises a first conveyor belt having a first speed and the second transportation section comprises a second conveyor belt having a second speed, the second speed being lower than the first speed.

As a result of this measure, the flat products are slowed when passing from the first transportation section into the second transportation section and are pushed one above the other. In this way an overlapping stream is obtained in a simple and gentle manner, which is then directly passed on.

In a further embodiment of the invention, the feed unit introduces two consecutive flat products of the second type between the flat products of the first type, whereupon, preferably with the stacking unit, the overlapping stream can be split in two between the two successive flat products of the second type, so that a first flat product of the second type forms the top cover of a leading stack and a second flat product of the second type forms the base of a trailing stack.

Such an embodiment of the device can serve to ensure in a simple way that each stack comprises a flat product of the second type at the top and bottom end, i.e. as the base and as the top cover, so to speak.

In a further embodiment of the invention, the device further comprises a synchronization unit, which synchronizes at least one of the transportation sections, and particularly both transportation sections, with the feed unit.

For purposes of the present invention, "synchronizing" shall be understood to mean that at a point on the transportation sections or the feed unit, the position and/or speed of a flat product is determined and the feed unit or the transportation sections are controlled in dependence on this determined position and/or speed.

Although it is possible to operate the feed unit purely on a time cycle basis, it has been shown, for example, that in the first transportation section interruptions can occur as a result of the presence of defective flat products. Hence it can no longer be ensured that the flat products of the second type delimit uniformly large stacks.

By contrast, a synchronization in the above-stated manner ensures that equal-sized stacks are always formed.

Preferably, the introduction of the flat products is synchronized with the transportation of the stream of flat products of the first type such that a flat product of the second type comes to lie roughly congruently on a flat product of the first type.

It has been shown that as a result of this measure, for example when two flat products of the second type are successively introduced, for the second flat product of the second type the same spacing between the flat products of the first type is available as if only one flat product of the second type is introduced, which, in turn, makes the introduction more reliable. This measure thus results, in turn, in a particularly reliable introduction of the flat products of the second type.

In a further embodiment of the invention, the transportation of the overlapping stream takes place in synchronization with the feeding of the flat products of the second type.

It has been shown that, for example, if a flat product of the second type is introduced at the interface between the first and the second transportation section, the fact that the speed of transportation to the second transportation section is briefly increased enables the time window for the possible introduction of a second flat product to be widened, since the latter is more quickly transported away from the stream of individual flat products. In this way, such a synchronization can also increase the reliability of the introduction.

In a further embodiment of the invention, the stacking device comprises a holding arm.

A holding arm has proved to be a mechanically particularly simple embodiment of the stacking device, which functions reliably even at high production speeds.

Self-evidently, the above-stated features and those which are yet to be set out below can be used not only in the respectively defined combination, but also in other combinations or in isolation, without departing from the scope of the present invention.

BRIEF DESCRIPTION OF THE DRAWINGS

The invention is described and set out in greater detail below with reference to selected illustrative embodiments, wherein.

DETAILED DESCRIPTION OF PREFERRED EMBODIMENTS

Figure 1:
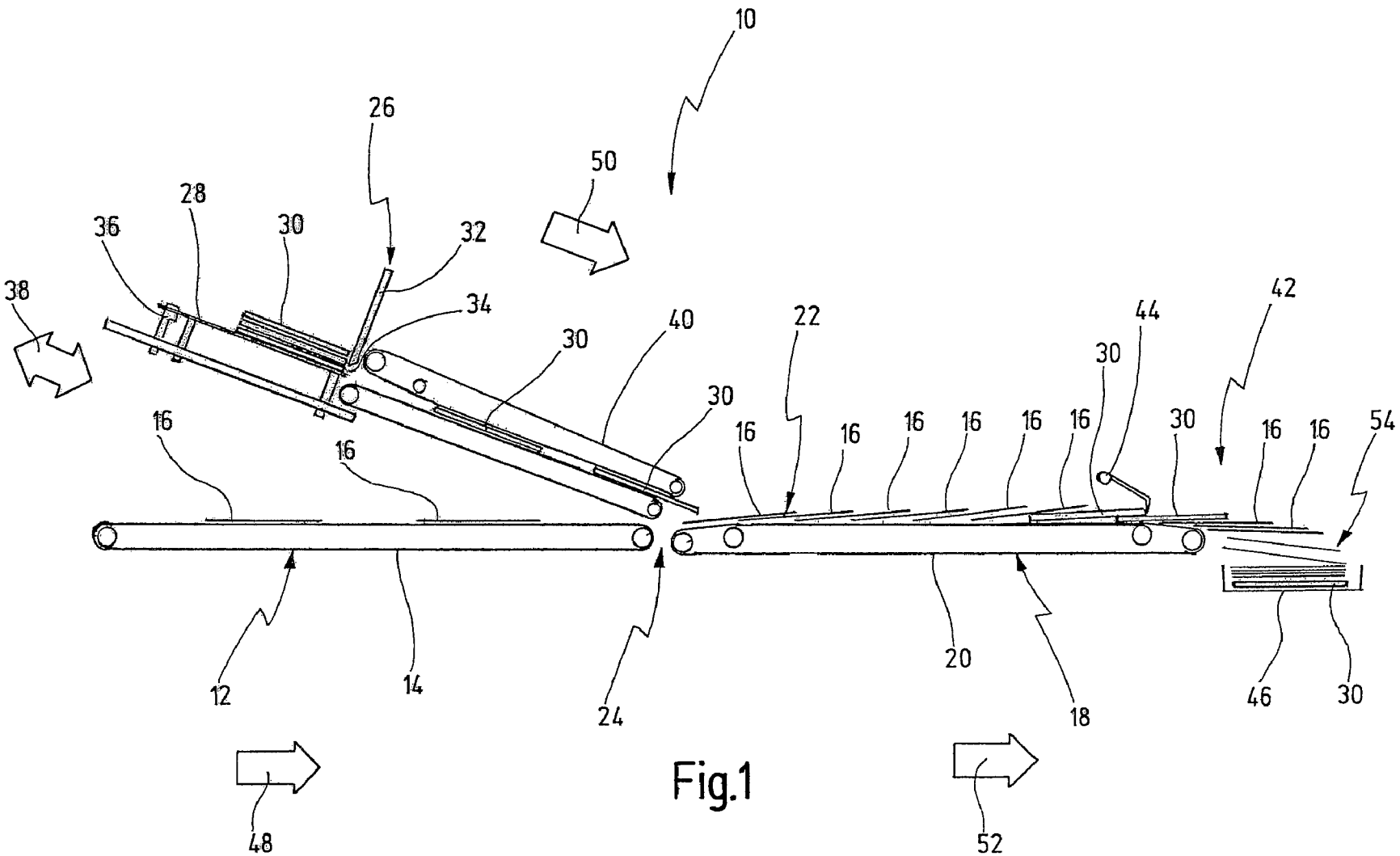
FIG. 1 shows a device for forming stacks of flat products.

In FIG. 1, a device for forming stacks of flat products is denoted in its entirety by the reference numeral 10.

The device 10 comprises a first transportation section 12 in the form of a first conveyor belt 14. On this conveyor belt 14, flat products of a first type 16, in this case printed and folded flyers, are being transported.

The first transportation section 12 is adjoined by a second transportation section 18 in the form of a second conveyor belt 20. On this conveyor belt there is disposed an overlapping stream 22 of the flat products of the first type 16.

At an interface 24, between the first transportation section 12 and the second transportation section 18, there is disposed a feed unit 26.

This feed unit 26 comprises a rest 28, on which flat products of a second type 30, in this case firm pieces of cardboard, are disposed. The rest 28 is inclined, so that the pieces of cardboard slide against a stop 32. The stop 32 comprises a slit 34 on its bottom side, whereby the height of the slit corresponds to the thickness of a piece of cardboard. The pieces of cardboard are held in their current position by mutual friction.

The feed unit 26 further comprises a movable driver 36, which can be moved to and fro in the direction of a double arrow 38. During operation, an upper edge of the movable driver 36 projects through a slit in the rest 28 beyond the top side of the rest 28. This slit extends in the drawing planes and allows the driver 36 to be moved in the direction of the double arrow 38. The driver 36 thereby projects beyond the rest 28 at a height corresponding to the thickness of a piece of cardboard.

If the movable driver 36 is now moved to the right in the direction of the double arrow 38, it pushes a piece of cardboard through the slit 34 and moves it in the direction of a conveyor belt 40 of the feed unit 26. During withdrawal back to the left in the direction of the double arrow 38, the driver dips below the rest 28, so that it is prevented from catching on the pieces of cardboard.

Both the height at which the driver 36 projects beyond the top side of the rest 28 and the height of the slit 34 are adjustable. Flat products of different thickness can hence be supplied with the feed unit 26.

The conveyor belt 40 picks up the piece of cardboard and introduces it directly at the interface 24 between the first transportation section 12 and the second transportation section 18 into the stream of flat products of the first type 16.

The feed unit is thereby synchronized with the first transportation section 12 such that, after a predefined number of flat products of the first type 16, in this case after nine such products 16, two flat products of the second type 30 are introduced into the stream of flat products of the first type 16.

At the end of the second transportation section 18 there is disposed a stacking unit 42. This stacking unit 42 comprises a holding arm 44 and a stack receptacle 46.

During operation, the flat products of the first type 16 are now moved in the direction of an arrow 48 on the first conveyor belt 14 in the direction of the second transportation section 18. Since the second conveyor belt 20 is operated at a lower speed than the first conveyor belt 14, the flat products of the first type 16 there pile one on top of the other and form the overlapping stream 22.

The number of flat products of the first type 16 which are transported on the first transportation section 12 is detected. If a predefined number of flat products of the first type 16 is reached, a synchronization unit calculates when the last desired flat product of the first type 16 will reach the interface 24. The feed unit 26 is then actuated such that at this moment two flat products of the second type 30 are automatically introduced in the direction of an arrow 50 into the stream of flat products of the first type 16.

Thus, in the second transportation section 18, an overlapping stream 22 is formed from a multiplicity of flat products of the first type 16, which are respectively interrupted at a predefined interval by two flat products of the second type 30.

This overlapping stream 22 is now moved in the direction of an arrow 52 on the second conveyor belt 20 in the direction of the stacking unit 42. If two successive flat products of the second type 30 now reach the stacking unit 42, then the holding arm 44 is introduced into the overlapping stream 22 such that this takes hold of and retains the second flat product of the second type 30.

The rest of the overlapping stream 22 is led off in the direction of the arrow 50 into the stack receptacle 46 and there forms a stack 54 of flat products of the first type 16, which is delimited respectively at the top and bottom by a flat product of the second type 30. This stack 54 can then be directly finished, for example banded or packed, in the stack receptacle, or can be removed from this receptacle and finished in a further step.

A more detailed description of the method according to the invention is now given with reference to the schematic representation of FIGS. 2 to 7.

Figure 2:
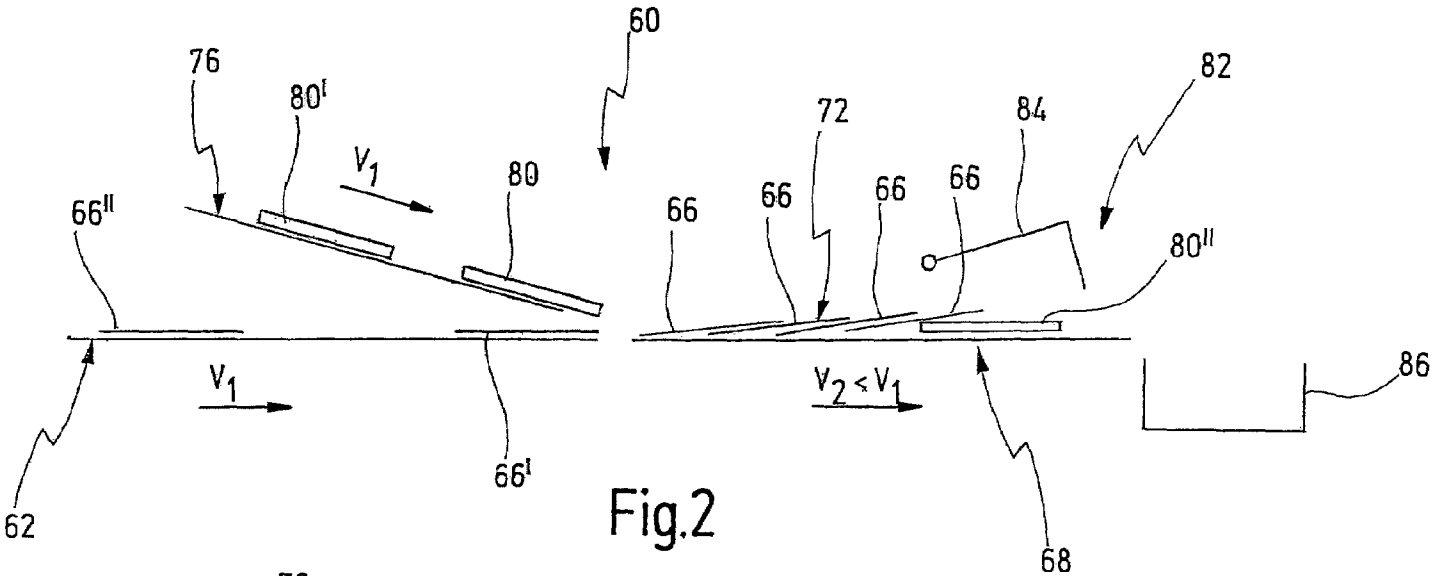
FIG. 2 shows in heavily schematized representation a first step of a method for forming stacks of flat products.

In FIG. 2, a device for forming stacks of flat products is denoted in its entirety by the reference numeral 60.

The device for forming stacks of flat products 16 comprises a first transportation section 62 for transporting flat products of a first type 66. The first transportation section 62 is adjoined by a second transportation section 68 for transporting an overlapping stream 72 of flat products. The device 60 further comprises a feed unit 76 for supplying flat products of a second type 80. The second transportation section 68 is adjoined on the right-hand side by a stacking unit 82, consisting of a holding arm 84 and a stack receptacle 86. This stacking unit 82 serves to form individual stacks from the overlapping stream 72.

During operation, flat products of a first type 66 are now transported on the first transportation section 62 at a speed $V_1$ from left to right, i.e. in the direction of the second transportation section 68.

The second transportation section 68 transports the flat products of the first type 66 at a speed $V_2$ which is less than the speed $V_1$ of the first transportation section 62. The flat products of the first type 66 are thereby pushed one over the other and form the overlapping stream 72.

The device 60 further comprises a detection unit for detecting the flat products of the first type 66. If a predefined number of flat products of the first type 66 is detected, then this detection unit determines the position of the flat product of the first type 66' which is intended to form the last flat product of the first type 66 of a stack. From the determined position and the speed, a calculation is made of the moment at which the flat product of the first type 66 arrives at the point at which the flat products of the second type 80 are supplied. The feed unit 76 thereupon accelerates two flat products of the second type 80, 80' to a speed $V_1$, to be precise in such a way that the first of the two flat products of the second type 80 arrives at the feed position at the same time as the flat product of the first type 66'. By virtue of the fact that the two flat products 80 and 66' arrive simultaneously at the position, they come to lie roughly congruently one upon the other in the feed. The fact that these are moved at the same speed also prevents any slippage.

Figure 3:
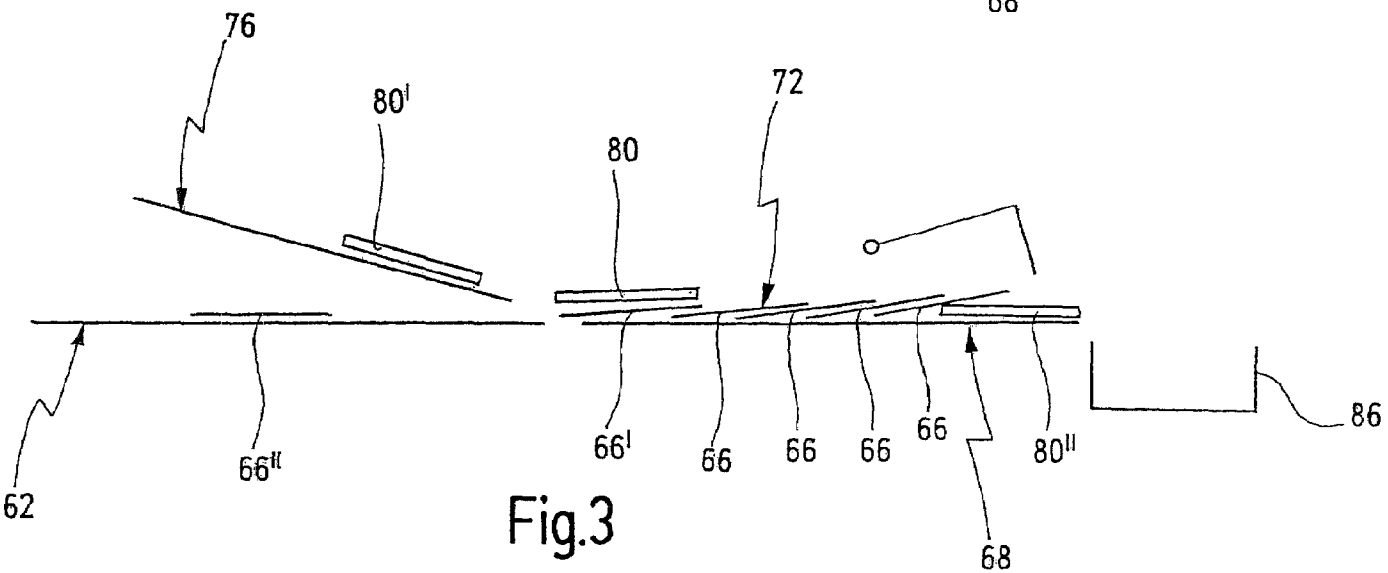
FIG. 3 shows in heavily schematized representation a second step of a method for forming stacks of flat products.

The state of the system following the supply of the first flat product of the second type 80 is represented in FIG. 3, from which it can be seen that the flat product of the first type 66' which is intended to form the last flat product of the first type 66 of a stack, and the first flat product of the second type 80 have come to lie roughly congruently one upon the other.

The overlapping stream 72, which is here delimited on the right side by a front flat product of the second type 80" and on the left side by the flat product of the second type 80, is moved onward by the second transportation section 68 in the direction of the stack receptacle 86.

The feed unit 76 introduces a further flat product of the second type 80' such that this is inserted between the flat product of the second type 80 and a flat product of the first type 60" into the overlapping stream 72. The overlapping stream 72 is thereby transported further to the right.

Figure 4:
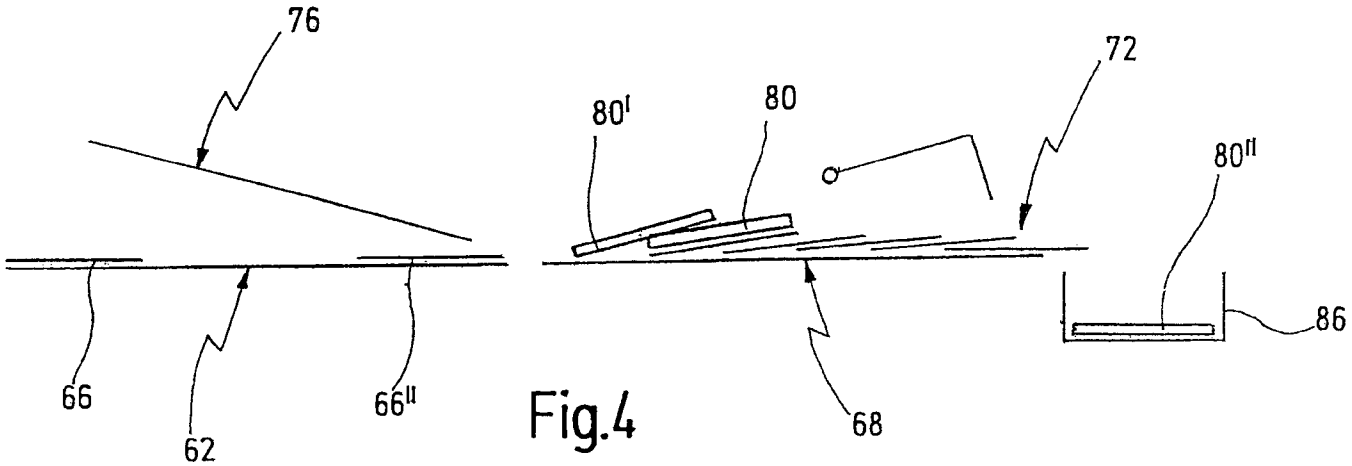
FIG. 4 shows in heavily schematized representation a third step of a method for forming stacks of flat products.

The state resulting therefrom is represented in FIG. 4.

It can be seen from FIG. 4 that the overlapping stream has been transported to the right to the point where the front flat product of the second type 80" has already fallen down into the stack receptacle 86. The fact that this falls down first into the stack receptacle 86 means that it forms the base of a stack to be formed.

The flat product of the second type 80' has come to lie on the flat product of the second type 80 and, together with the latter, is transported to the right within the overlapping stream 72.

Figure 5:
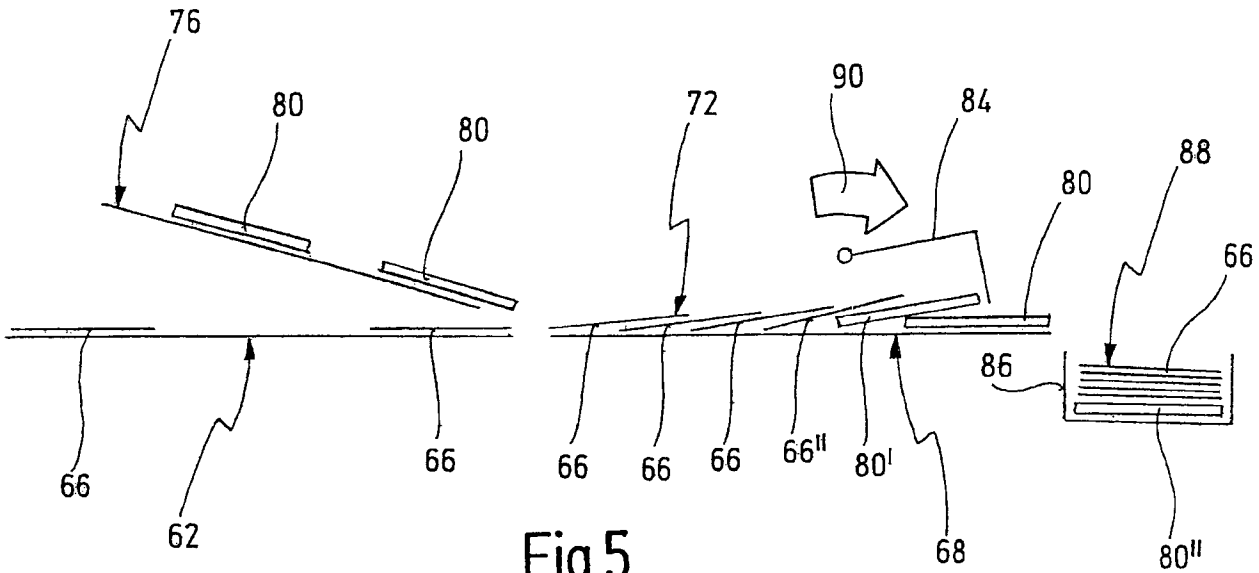
FIG. 5 shows in heavily schematized representation a fourth step of a method for forming stacks of flat products.

In FIG. 5, the situation following a further transportation of the overlapping stream to the right is represented. The flat product of the second type 80" and five successive flat products of the first type 66 of the overlapping stream 72 have fallen into the collecting receptacle 86 and have there formed a stack 88.

As soon as the flat product of the second type 80 which is intended to form the top cover of the stack 88 has reached the end of the second transportation section 68, this is detected in a detection unit and the holding arm 84 swings down in the direction of the arrow 90. The holding arm hereupon takes hold of the flat product of the second type 80' which is intended to form the base of the next stack and retains it. The overlapping stream 72 is thereby split into individual stacks, which are respectively delimited at the top and bottom, i.e. in the form of a base and a top cover, by flat products of the second type 80.

Figure 6:
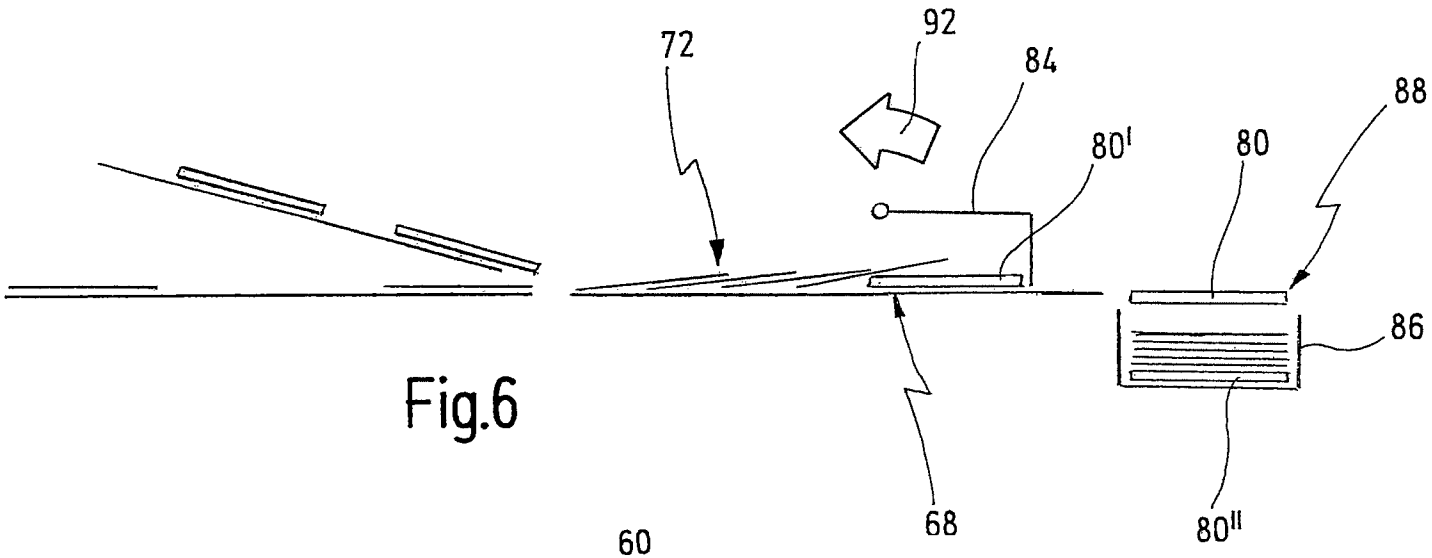
FIG. 6 shows in heavily schematized representation a fifth step of a method for forming stacks of flat products.

The second transportation section 68 now transports the flat product of the second part 80 in the direction of the collecting receptacle 86, so as there to complete the stack 88. This state is represented in FIG. 6. It can hereby be seen that the flat product of the second type 80' and hence the overlapping stream 72 is retained by the holding arm 84. When the stack 88 in the stack receptacle 86 is complete, it can either be directly banded or packed there, or can be transported away therefrom and finished elsewhere. As soon as the stack 88 is removed from the collecting receptacle 86, the holding arm 84 is swung up in the direction of the arrow 92 and releases the overlapping stream 72.

Figure 7:
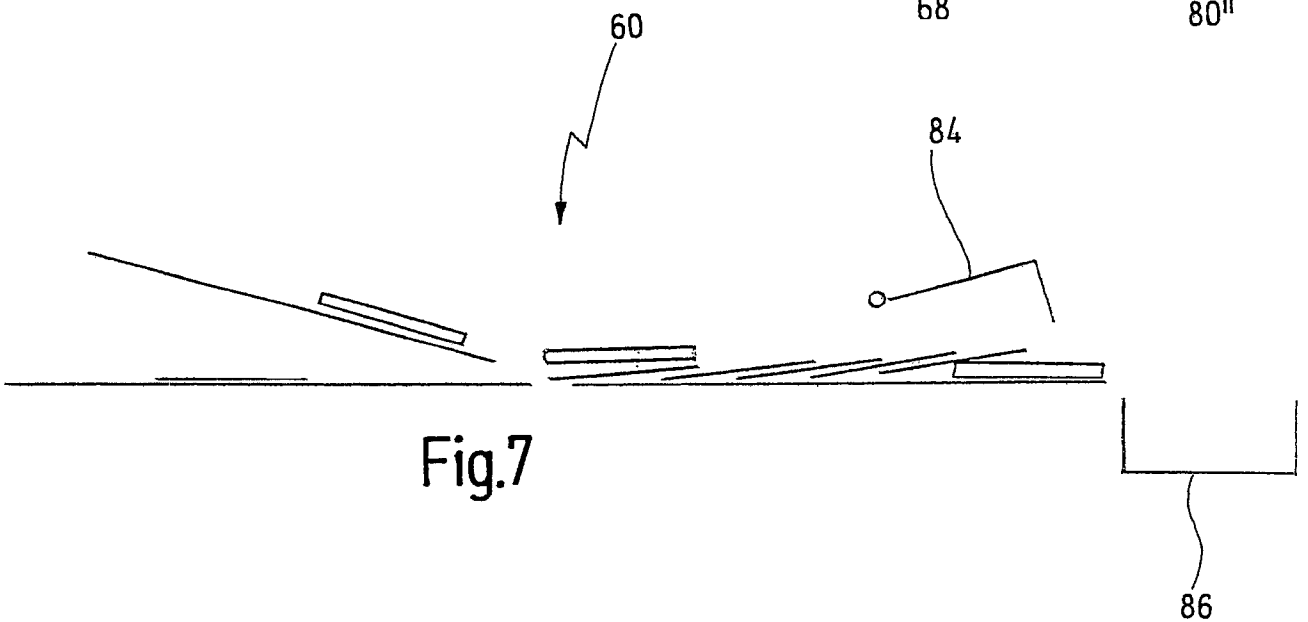
FIG. 7 shows in heavily schematized representation a sixth step of a method for forming stacks of flat products.

The situation following an onward transportation of the overlapping stream 72, after the holding arm 84 has been opened, is represented in FIG. 7. This situation corresponds to the situation represented in FIG. 3 and, from here on, this process can be cyclically repeated until the desired number of stacks has been produced.

What is claimed is:

1. A device for forming stacks of flat products, comprising:

a first transportation section for transporting a stream of individual flat products of a first type, a second transportation section for forming an overlapping stream from said flat products of said first type, a stacking unit for forming individual stacks from said overlapping stream, and a feed unit for flat products of a second type, whereby said feed unit introduces said flat products of said second type inline into said stream of individual flat products of said first type, whereby said feed unit introduces two consecutive flat products of said second type between said flat products of said first type, and further whereby, with said stacking unit, said overlapping stream can be split in two between said two consecutive flat products of said second type, so that a first flat product of said second type forms a top cover of a leading stack and a second flat product of said second type forms a base of a trailing stack.

2. The device of claim 1, further comprising an interface between said first transportation section and said second transportation section, whereby said feed unit introduces said flat products of said second type at said interface between said first transportation section and said second transportation section into said stream of individual flat products of said first type.

3. The device of claim 1, whereby said first transportation section comprises a first conveyor belt having a first speed, and said second transportation section comprises a second conveyor belt having a second speed, said second speed being lower than said first speed.

4. The device of claim 1, further comprising a synchronization unit, which synchronizes at least one of said transportation sections with said feed unit.

5. The device of claim 4, whereby said synchronization unit synchronizes both transportation sections with said feed unit.

6. The device of claim 1, whereby said stacking unit comprises a holding arm for holding a part of said overlapping stream.

7. A method for forming stacks of flat products, comprising the following steps:

(a) producing a stream of individual flat products of a first type;

(b) transporting said stream of individual flat products of said first type;

(c) forming an overlapping stream from said individual flat products of said first type; and (d) forming individual stacks from said overlapping stream;

whereby in step (b) at least one flat product of a second type is introduced inline into said stream of flat products of said first type, whereby in step (b) two consecutive flat products of said second type are introduced into said stream of flat products of said first type, and further whereby in step (d) said overlapping stream is split into stacks such that a first flat product of said second type forms a top cover of a leading stack and a second flat product of said second type forms a base of a trailing stack.

8. The method of claim 7, whereby said introduction of said flat products of said second type takes place in synchronization with said transportation of said stream of individual flat products of said first type.

9. The method of claim 8, whereby said introduction of said flat products of said second type is synchronized with said transportation of said stream of flat products of said first type such that a flat product of said second type comes to lie roughly congruently on a fiat product of said first type.

10. The method of claim 7, whereby a transportation of said overlapping stream takes place in synchronization with said introduction of flat products of said second type.

* * * * *